United States Patent [19]

Ecklund et al.

[11] Patent Number: 4,580,284

[45] Date of Patent: Apr. 1, 1986

[54] PILOT TONE CANCELLING CIRCUIT FOR AM STEREO DECODER

[75] Inventors: Lawrence M. Ecklund, Wheaton; Charles J. Marik, Richmond, both of Ill.

[73] Assignee: Motorola, Inc., Schaumburg

[21] Appl. No.: 621,283

[22] Filed: Jun. 15, 1984

[51] Int. Cl.[4] ..... H04H 5/00

[52] U.S. Cl. ..... 381/15; 455/304; 455/306

[58] Field of Search ..... 381/13, 15, 16; 455/303-306

[56] References Cited

U.S. PATENT DOCUMENTS 4,314,377 2/1982 Kondo et al. ..... 381/13

4,409,436 10/1983 Numata et al. ..... 381/15

*Primary Examiner*—Forester W. Isen

*Attorney, Agent, or Firm*—Margaret Marsh Parker; James W. Gillman

[57] ABSTRACT

In an AM stereo system wherein a low frequency pilot tone is added to the difference channel signal before modulation of the carrier, "image shifting" and audio distortion in a receiver, due to residual pilot tone signal, are removed by separating out a portion of the pilot tone after it has been filtered and phase shifed for enabling the stereo mode of operation. The separated signal is then inverted and delayed appropriately for each of the PLL and audio circuits.

2 Claims, 4 Drawing Figures

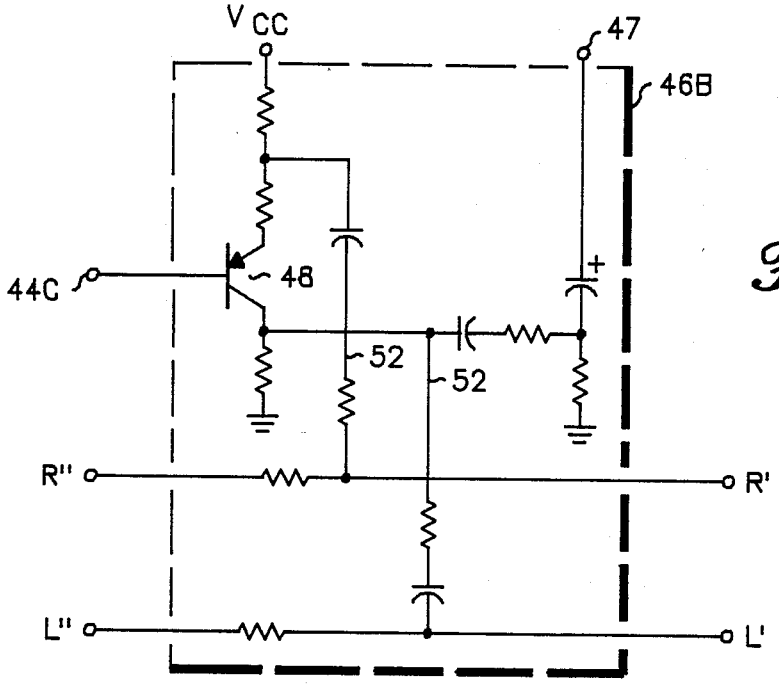
Fig. 2
Fig. 3
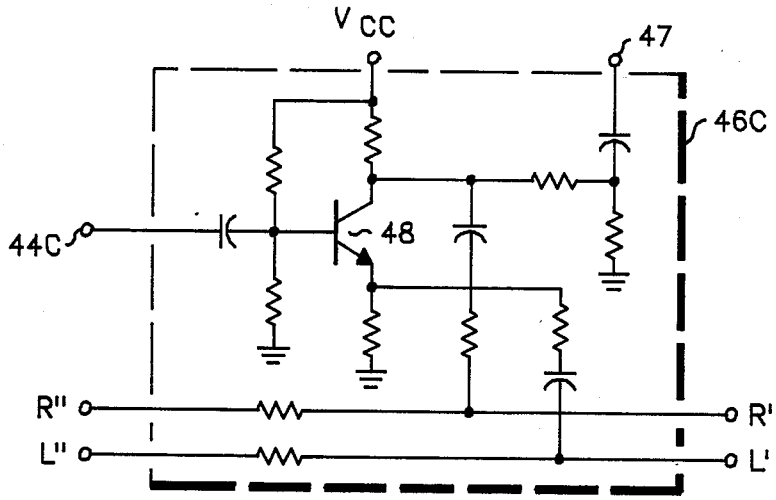

PILOT TONE CANCELLING CIRCUIT FOR AM STEREO DECODER

BACKGROUND OF THE INVENTION

This invention relates to the field of AM stereophonic receivers and, more particularly, to the prevention of intermodulation distortion and other forms of distortion due to the presence of the pilot tone in the stereo difference signal.

In stereophonic broadcasting, a "pilot tone" is usually added to the modulating signal in such a way that a receiver can detect the presence of the pilot tone and use that information to indicate to the user that a stereo station has been tuned in. Typically, the information is also used for other purposes such as enabling stereo operation in the receiver.

In AM stereo transmission, a subaudible or nearly subaudible tone is usually added to the L−R or difference channel before the difference signal is modulated onto the carrier. In the receiver this tone is separated from the L−R signal and utilized as desired. However, due to the fact that the pilot tone is so near in frequency to the desired audio signals, it is sometimes difficult to completely eliminate the tone from the L−R signal.

The pilot tone can have two undesired effects, both appearing in the audio circuits where it can produce objectionable sounds in the audio output channels and can also cause apparent shifting of the audio "image". The latter effect is a form of intermodulation distortion and is caused by the pilot tone affecting the phase locked loop used in the detection circuits of some AM stereo receivers.

Additional information on such receivers may be found in U.S. Pat. Nos. 4,159,398, 4,405,837 and 4,410,762 assigned to the assignee of the present invention.

SUMMARY OF THE INVENTION

It is therefore an object of the present invention to provide simple and efficient means for preventing the possible undesired effects of pilot tone in the audio signals of an AM stereo receiver.

The cancellation of the pilot tone is done in accordance with the present invention by coupling into the circuitry of the AM stereo IC at the point where the pilot tone signal has been phase shifted and filtered to separate pilot tone and L−R signals. The pilot tone signal is then inverted and coupled into the circuit of the voltage controlled oscillator which is a part of the phase locked loop in the stereo signal correction circuit. A portion of this same signal may also be used to remove any residual pilot tone signal from the stereophonic audio signals.

BRIEF DESCRIPTION OF THE DRAWING

FIG. 2 is a circuit diagram of a second embodiment of one portion of the diagram of FIG. 1.

FIG. 3 is a circuit diagram of still another embodiment of the circuit portion shown in FIG. 2.

DETAILED DESCRIPTION OF THE PREFERRED EMBODIMENTS

Figure 1:
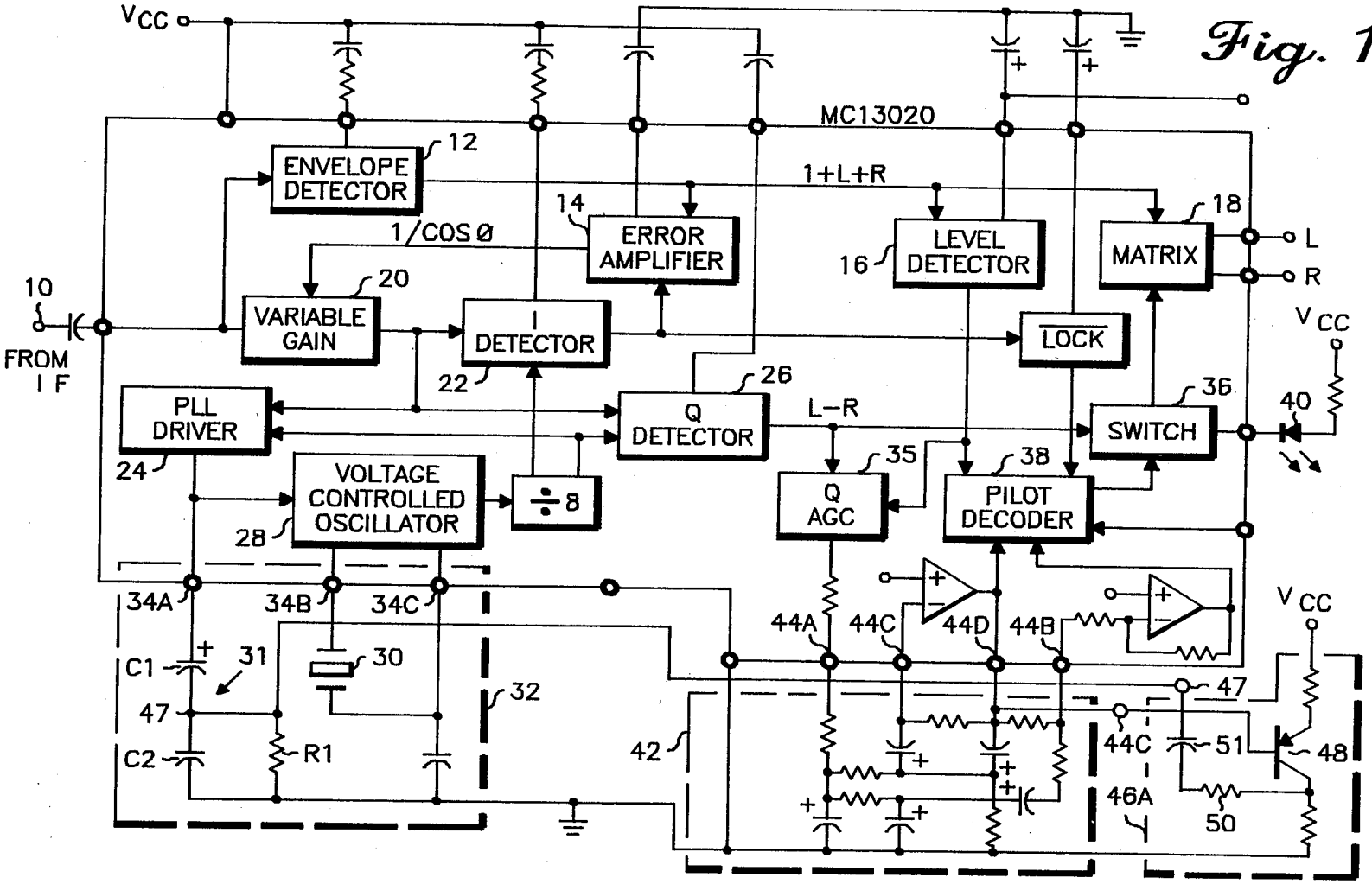
FIG. 1 is a combination block/schematic diagram of an integrated circuit designed for use in AM stereo signal decoding with related off-chip circuits.

FIG. 1 shows an AM stereo decoder and includes a block diagram of an integrated circuit known as the MC13020, manufactured by Motorola, Inc. for use with the compatible quadrature system of AM stereo termed C-QUAM ®. However, the invention is not limited to use with any specific IC and not necessarily to use with this particular AM stereo system.

Any receiver using this IC would, of course, include input stages such as RF/IF/mixer stages (not shown) and the signal coupled to the IC at an input terminal 10 would, typically, be an IF signal. This signal would be coupled to an envelope detector 12, whose output of 1+L+R is coupled to an error amplifier 14, a level detector 16 and a matrix 18. The IF signal is also coupled to a variable gain circuit 20 which also receives an error signal 1/cos $\phi$ from the error amplifier 14. The corrected output of the gain circuit 20 is coupled to an I detector 22, a PLL driver stage 24 and a Q detector 26. The PLL driver stage 24 is sometimes termed a "phase detector", but its function is to provide to the VCO a current proportional to the output voltage of the Q detector 26. The I detector 22 and Q detector 26 are synchronous detectors and receive in-phase and quadrature inputs, respectively, from a VCO 28. Lacking any signal correction, the output signals from the I detector 22 and the Q detector 26 would be (1+L+R)cos $\phi$ and (L−R)cos $\phi$, respectively. A crystal 30, a PLL filter 31, and other oscillator components, all of which will vary according to the specific type of oscillator used, are shown off-chip in a dashed box 32, coupled to the chip by terminals 34A,34B,34C. The use of a crystal oscillator rather than another type of oscillator is, of course, a design choice. The PLL filter 31 includes capacitors C1,C2 and a resistor R1, of which C1 is the main factor in setting the corner frequency of the PLL.

The output of the I detector 22 is coupled to the error amplifier 14 where it is compared with the output signal (1+L+R) of the envelope detector 12. The error signal of 1/cos $\phi$ from the error amplifier 14 controls the variable gain circuit 20, forcing the output of the I detector 22 to become 1+L+R. The same error signal is coupled to the Q detector 26 forcing its output to become L−R, the accurate difference signal. The L−R signal is coupled to a Q AGC circuit 35 which also receives a control signal from the level detector 16. The L−R signal is also coupled, through a switching circuit 36 controlled by the output of a pilot tone decoder circuit 38, to the matrix 18 and to an external stereo indicator 40. The signals at the outputs L,R of the matrix 18 are the left and right stereophonic signals. These signals would be coupled to off-chip audio circuits (not shown).

In a dashed block 42 (off-chip) are several filters. One is a low pass filter which filters the AGC'd Q signal coming from a terminal 44A. Another low pass filter is coupled into a terminal 44B, the "co-channel" input, and a bandpass filter is coupled into terminals 44C,44D, the "pilot filter input" and "pilot detector input", respectively, of the exemplary IC MC13020. The bandpass filter passes the pilot tone frequency, which is 25 Hz in the C-QUAM system.

If the signal going into the phase locked loop, which includes the PLL driver stage 24, the network 32 and the VCO 28 and which is used in decoding the L−R signal, contains any perceptible amount of the pilot tone, the pilot tone could vary the instantaneous phase of the VCO. Such a change will produce an audio image shift at the frequency of the pilot tone which could, under some circumstances, cause a form of intermodulation distortion.

A block 46A is coupled between the terminal 44D and a terminal 47 in the block 32 (a "phase detector" or PLL driver input terminal) for the purpose of removing any residual pilot tone from the VCO input. At this point in the decoder circuit, the pilot tone has been separated from the Q or L−R signal. The filtered pilot tone normally coupled into the terminal 44D is here also being coupled into a transistor amplifier 48 in the block 46A where it is inverted, then coupled into the terminal 47 of the filter for the PLL by way of a resistor 50 and a capacitor 51. At the terminal 47, any pilot tone signal being injected is of the proper phase and amplitude so that, when it is coupled into this control terminal, any effect of residual pilot tone on the operation of the I and Q detectors 14, 26 is essentially eliminated.

In FIG. 2 is shown a block 46B which could, alternatively, be coupled to the terminals 47,44D. In this embodiment not only would the pilot tone be removed from the VCO control input, as in FIG. 1, but any residual pilot tone would be also be removed from the L and R output signals of the matrix 18. The L and R terminals of the matrix 18 are coupled to terminals L′ and R′, respectively, of the block 46. The pilot tone is essentially eliminated from the L and R signals by the normal and inverted pilot tone signals from the transistor amplifier 48 before the L and R signals are coupled to the external audio circuits (not shown) via terminals L″,R″. Since any residual pilot tone has been phase shifted in the low pass filter which precedes the band pass filter in the filter block 42, two high pass filters 52 have been coupled to the output terminals of the amplifier 48 in order to return the pilot tone to the correct phase for providing accurate L and R audio signals.

FIG. 3 shows a block 46C, another embodiment of the circuit block 46B of FIG. 2. The block 46C is also coupled between the terminals 44D and 47 and also to the L and R terminals of the IC as before, and functions in similar fashion to eliminate residual pilot tone from both the PLL and the audio outputs. This embodiment, however, provides for a wider range of difference between the delays in the residual pilot tone at the VCO input and the pilot tone detector input.

Figure 4:
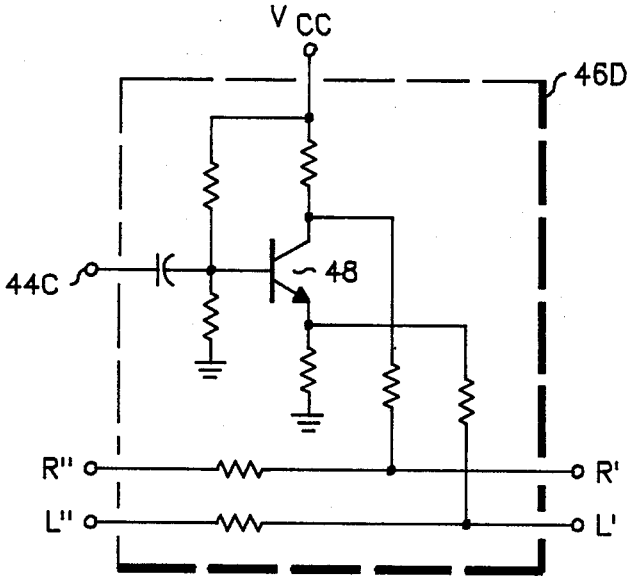
FIG. 4 is a circuit diagram of a fourth embodiment of the circuit portion of FIG. 2.

In FIG. 4 may be seen a block 46D which could be coupled between the terminal 44D and also to the L and R terminals of the IC. The circuit of block 46D may be used as a pilot tone canceller for the audio signals in decoders wherein the loop filter is low enough in frequency so that no intermodulation due to the pilot tone exists. This circuit is very similar to those of FIGS. 2 and 3, except that the high pass phase shift components are at the input to the buffer amplifier, thus requiring fewer components than before. If the circuitry coupled to the terminals L″, R″ does not require DC blocking, the output coupling from the transistor 48 may be provided by simple resistive coupling.

Thus there has been shown and described means for preventing the undesired effects of residual pilot tone signal in the inputs of either the PLL or the audio output circuits. It will be apparent that many variations and modifications of the invention are possible and it is intended to cover all such as fall within the spirit and scope of the appended claims.

What is claimed is:

1. A pilot tone cancelling circuit as for use in an AM stereophonic decorder and comprising: input means for receiving an AM stereophonic signal including a pilot tone signal;

demodulating means for deriving from said received signal a difference channel signal (L−R) including said pilot tone signal;

a phase locked loop (PLL) including a voltage controlled oscillator and filter means coupled to the input of said oscillator;

first pilot tone circuit coupled to said demodulating means for separating said pilot tone signal from the difference channel signal for indicating and enabling stereo mode operation;

second pilot tone circuit coupled to said first pilot tone circuit and including inverting means and time delay means for inverting and delaying a portion of said separated pilot tone signal, said signal portion being coupled to said PLL filter means for neutralizing residual pilot tone signal at the input of said voltage controlled oscillator.

2. A pilot tone cancelling circuit in accordance with claim 1 and wherein the decoder further includes audio circuits, the circuit further including second delay means coupled to said inverting means and to said audio circuits for coupling a second portion of said separated pilot tone signal to said audio circuits for neutralizing residual pilot tone signal in the output signals of the audio circuits.

* * * * *